United States Patent [19]

Meyer

[11] 4,295,571

[45] Oct. 20, 1981

[54] FILE FOLDER SUPPORT RACK

[75] Inventor: Stephen T. Meyer, Carmel, Ind.

[73] Assignee: Deflecto Corporation, Indianapolis, Ind.

[21] Appl. No.: 34,174

[22] Filed: Apr. 27, 1979

[51] Int. Cl.[3] ..... A47B 3/02; B42F 15/00

[52] U.S. Cl. ..... 211/200; 211/45; 211/46; 108/118; 248/164; 312/184

[58] Field of Search ..... 211/200, 45, 46; 108/118, 120, 119; 248/163, 164, 431, 432

[56] References Cited

U.S. PATENT DOCUMENTS

| | | | |
|---|---|---|---|
| 146,087 | 12/1873 | Miller . | |
| 318,336 | 5/1885 | Weidner | 211/200 |
| 1,261,761 | 4/1918 | Bush | 248/432 |
| 1,608,924 | 11/1926 | Brown | 108/118 |
| 1,664,059 | 3/1928 | Cable | 108/118 |
| 2,019,090 | 10/1935 | Pepper | 211/45 |
| 2,706,829 | 4/1955 | Charnin | 211/200 |
| 2,841,797 | 7/1958 | Kennedy | 108/119 |
| 3,081,717 | 3/1963 | Yurevich | 312/111 |
| 3,236,387 | 2/1966 | Perini | 248/164 |
| 3,356,228 | 12/1967 | Woodhouse | 211/45 |
| 3,630,387 | 12/1971 | Wehner | 211/46 |
| 3,788,718 | 1/1974 | Bjorn et al. | 312/184 |
| 3,848,748 | 11/1974 | Ceccarelli | 211/46 |
| 3,860,119 | 1/1975 | Irvine et al. | 211/45 |
| 3,999,663 | 12/1976 | Walter et al. | 211/46 |
| 4,030,610 | 6/1977 | Alexander | 312/184 |
| 4,049,127 | 9/1977 | Alexander | 312/184 |
| 4,091,933 | 5/1978 | Alexander | 211/46 |

FOREIGN PATENT DOCUMENTS

| | | | |
|---|---|---|---|
| 803540 | 10/1958 | United Kingdom | 211/200 |
| 833108 | 4/1960 | United Kingdom | 211/46 |

*Primary Examiner*—Victor N. Sakran

*Attorney, Agent, or Firm*—Woodard, Weikart, Emhardt & Naughton

[57] ABSTRACT

A file folder support rack for suspending in an upright, readily accessible orientation legal-size file folders or regular-size file folders of the type having support hooks on the corners includes two aligned, yet spaced apart offset X-shaped end frame members and four side rails extending between corresponding corners of the end frame members. The various side rails each have an edge portion which is sized and positioned suitably to receive the support hooks of the file folders and wherein the distance of separation between one pair of side rails is approximately 15 inches and the distance of separation between the opposite pair of side rails is approximately 12 inches. Each end frame member includes two arm portions which are substantially flat yet contoured and reinforced so as to abuttingly engage each other such that when said support rack is unfolded into the offset X-shaped configuration, the frame is an upright and free-standing structure. When it is desired to support legal-size file folders, the support frame rests on the 12-inch span thereby providing the 15-inch span for the file folder and when inverted, the support rack rests on the 15-inch span and makes available the 12-inch span for supporting regular-size file folders.

6 Claims, 12 Drawing Figures

FILE FOLDER SUPPORT RACK

BACKGROUND OF THE INVENTION

This invention relates in general to support structures suitably arranged to support or suspend other articles. More particularly, this invention relates to frame-like structures arranged so as to support hanging file folders in an upright, accessible orientation.

While almost everyone is aware of paper folders for storing papers and documents, these types of folders are primarily best suited for flat stacking and carrying. However, when folders are needed in order to organize material in a vertical file cabinet, such paper folders are not necessarily well suited for this purpose. This is because there is a tendency of such folders to sag and slide within the drawer when they are not tightly packed together, and thus, the folders are not always upright nor are the legends of such folders always visible.

This situation has been recognized by the file folder industry and at least one solution has been provided. This one solution is to use hanging file folders which have support hooks on the four corners and are thus able to be supported by rails or bars within the file drawer. This type of file folder is freely suspended up off the bottom of the drawer and maintains a virtually identical upright height with all other file folders in the drawer. These hanging file folders are able to slide from the front to rear of the file drawer across the supporting rails or bars and there is no need to tightly pack the files together in order to keep them in an upright orientation. There is, however, one drawback with this type of file folder as well as with conventional file folders, and that is how to maintain them in a convenient and accessible manner once they are pulled from the file or desk drawer where they are being stored. The most common technique is to lay the files flat on the work surface and shuffle through them as the user reviews information in one file and then another. While this technique is workable, it is somewhat messy and awkward and definitely not efficient. The files slide with respect to each other and if the work surface must be cleared, such as for a conference with another person, the files have to be temporarily disposed of and this usually means refiling them in the drawer.

It would be an improvement to this overall situation of file folder manipulation if a free-standing support rack could be provided which would support, in an upright, accessible orientation, several hanging-type file folders. Such a rack could be used either as an insert to a desk drawer or on top of the work surface and files pulled from a drawer could be loaded into the rack. The upright and suspended orientation would allow quick flipping from file to file without the aforementioned awkwardness and inefficiency. A further improvement would be to construct such a rack so as to be capable of supporting legal-size file folders as well as regular-size file folders and to make the rack collapsible for easy packaging and storage. The subject invention disclosed herein provides such improvements by way of a rack which is constructed to also provide other advantages as will be apparent.

While prior art is not known to exist which anticipates this invention, certain patent references may be deemed to have a certain degree of relevancy, at least to the extent that they provide an indication of other concepts which have been employed for supporting and retaining structures. These patents are listed below.

| Pat. No. | Patentee | Issue Date |
|---|---|---|
| 146,087 | Miller | 12/30/73 |
| 318,336 | Weidner | 5/19/85 |
| 4,049,127 | Alexander | 9/20/77 |
| 3,630,387 | Wehner | 12/28/71 |
| 3,848,748 | Ceccarelli | 11/19/74 |
| 3,788,718 | Bjorn et al. | 1/29/74 |
| 3,860,119 | Irvine et al. | 1/14/75 |
| 3,999,663 | Walter et al. | 12/28/76 |

Miller discloses a clothes frame wherein two pivotal X-shaped end members are connected together by a number of round bars.

Weidner discloses a display rack for brooms and similar implements which includes a pair of collapsible X-shaped wooden members with a number of holes therein for receiving the handle portions of such brooms or similar implements.

Alexander discloses a hanging file support frame which includes a pair of file folder support rails and a pair of transverse members. Four corner fittings are supported in an elevated position and each has a substantially vertical slot for receiving one end of a rail and a substantially horizontal slot for receiving one end of a transverse member.

Wehner discloses a collaspible file support structure for the vertical filing of file wrappers or similar objects wherein the collapsible file support structure has a pair of longitudinally spaced end frame members each of which has a pair of upright members and rigid bracing members extending therebetween.

Ceccarelli discloses a support member of bent stiff wire for suspending files or the like and is designed to be removably insertable into a furniture drawer.

Bjorn et al. discloses a frame for hanging folders in filing cabinet drawers which includes a pair of spaced plastic end panels adapted to be positioned within the front and rear of the drawer and a pair of plastic side rails each having a series of spaced holes therein for receiving the rods of hanging folders.

Irvine et al. discloses a combination of separate components fabricated for shipment in knock-down form which may be readily assembled to provide a simple, secure support frame for hanging file folders. The four corners of the structure comprise junctures of the longitudinal side bars, cross bars and leg supports for the structure.

Walter et al. discloses a frame for hanging file folders which is adjustable both longitudinally and laterally and includes longitudinal rails for suspending the folders in an upright position.

As will be apparent from the disclosure which follows, none of these listed patents provide a lightweight, upright, free-standing rack for supporting hanging file folders wherein one orientation of the rack is suitable to support legal-size file folders while an inverted orientation of the same rack supports regular-size file folders.

SUMMARY OF THE INVENTION

A file folder support rack for retaining file folders of the type having a support hook on each of the corners in a suspended, upright orientation according to one embodiment of the present invention comprises two aligned, oppositely disposed end frame members each having a configuration which provides a four-corners arrangement, the upper two corners of each end frame member having substantially the same first distance of separation and the lower two corners of each end frame member having substantially the same second distance of separation, the second distance of separation being different than the first distance of separation, and a plurality of side rails extending between the corners of one end frame member and corresponding corners of the other end frame member, each of the side rails having an edge portion suitable to receive the support hooks of the file folders.

One object of the present invention is to provide an improved file folder support rack of the type capable of suspending both legal-size file folders and regular-size file folders.

Related objects and advantages of the present invention will be apparent from the following description.

DESCRIPTION OF THE PREFERRED EMBODIMENT

Figure 1:
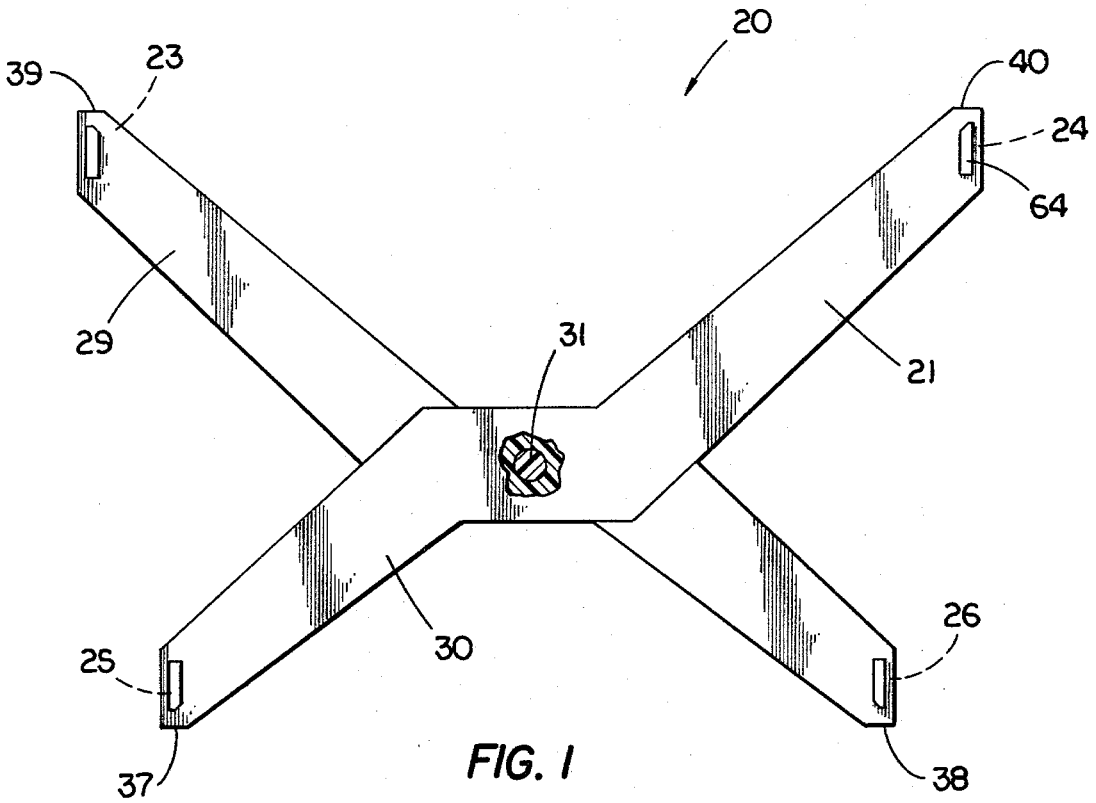
FIG. 1 is a front elevation view of a file folder support rack according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contempleted as would normally occur to one skilled in the art to which the invention relates.

Referring to FIGS. 1, 2, 3 and 12 there is illustrated file folder support rack 20 which includes a first end frame member 21 and spaced apart from, yet correspondingly aligned with, a second end frame member 22. Extending between these two end frame members are four similarly arranged side rails 23, 24, 25 and 26 which snap into the free ends of the two end frame members in a corresponding arrangement which results in an upright, free-standing support rack.

Figure 4:
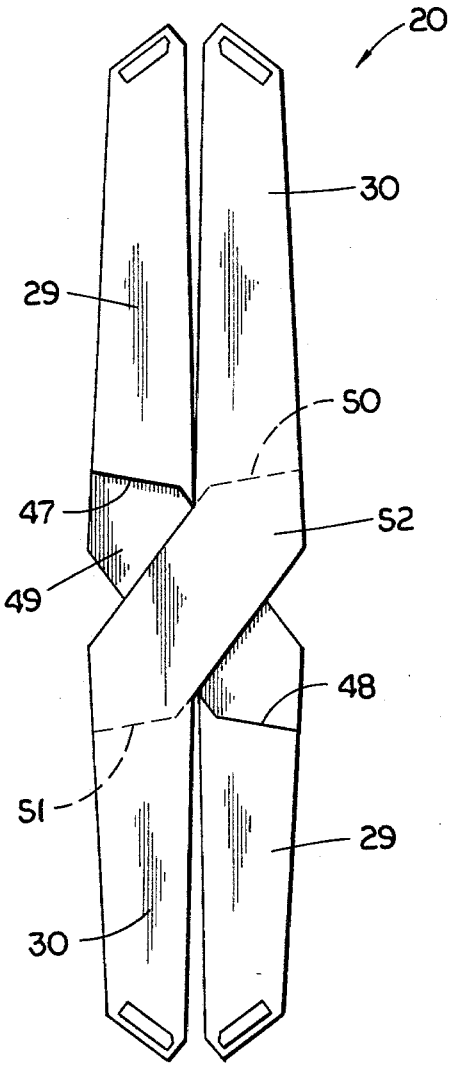
FIG. 4 is a front elevation view of the FIG. 1 file folder support rack in a collapsed position.

First end frame member 21 includes a first arm portion 29 and a second arm portion 30 both of which are substantially flat yet contoured with edges and reduced-thickness portions so as to create the expanded offset X-shape which is illustrated in FIG. 1. Certain outer edges of one arm portion abut interior recess edges of the other arm portion on one side with the reverse abutment concept occurring on the opposite side. This edge contouring is best illustrated in FIG. 4 which will be discussed hereinafter. First arm portion 29 is pivotally connected to second arm portion 30 by means of a pivot pin which in the exemplary embodiment is a shouldered bolt which extends through a snug fitting clearance hole in first arm portion 29 and is threadedly received by an internally threaded hole in second arm portion 30. A virtually identical arrangement to what has just been described exists for second end frame member 22 wherein first arm portion 32 is pivotally connected to second arm portion 33 by pivot means 34 which in the exemplary embodiment is also a shouldered bolt which is installed in a manner similar to shouldered bolt 31. Pivot means 31 and 34 may alternatively be any pin-like member and may in fact be a molded plastic part which merely snaps in place between the corresponding two arm portions in order to both hold them together while at the same time providing pivotal motion between the arm portions. This pivoting motion enables the two arm portions of each end frame member to move with respect to each other between an expanded free-standing orientation as illustrated in FIG. 1 and a collapsed orientation as is illustrated in FIG. 4.

Figure 10:
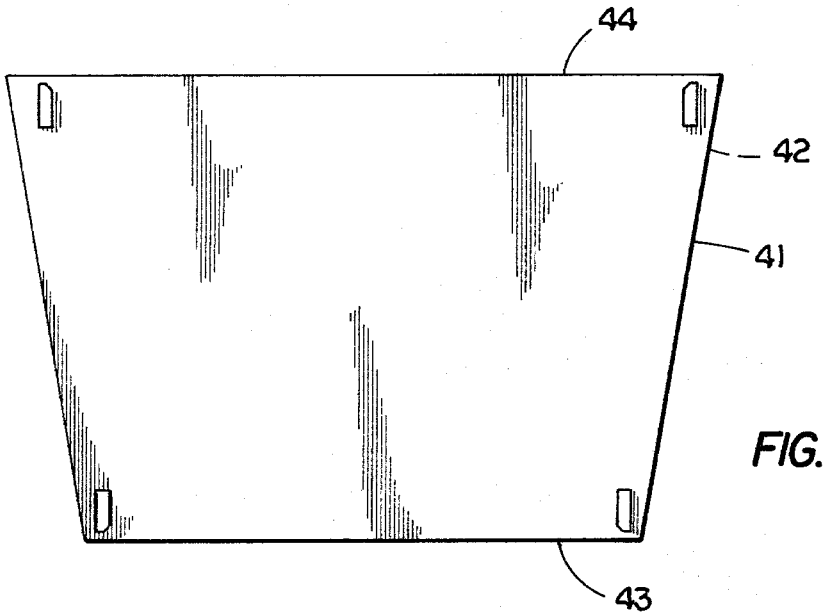
FIG. 10 is a front elevation view of an alternative arrangement to the FIG. 1 file folder support rack.

Inasmuch as first end frame member 21 is virtually identical to second end frame member 22, it should be understood that the appearance of this file folder supporting rack is the same from either end and similarly inasmuch as the various side rails are also virtually identical, the view of the file folder support rack 20 is virtually the same from either side. However, one difference is noted between the top and bottom views inasmuch as the expanded configuration of support rack 20 is an offset "X" shape. This particular shape provides a first distance of separation between side rails 23 and 24 and a different distance of separation between side rails 25 and 26. The arrangement of support rack 20 is such that in the illustrated orientation of FIG. 1, lower edges 37 and 38 are of sufficient span and shape to support rack 20 even when loaded with hanging file folders. Similarly, the FIG. 1 illustration can be inverted such that edges 39 and 40 are responsible for the supporting of rack 20. The ability to invert support rack 20 from one orientation to the other means that in one orientation, that illustrated in FIG. 1, the distance of separation between side rail 23 and side rail 24 is approximately 15 inches and generally corresponds to the dimension between opposite side support hooks of a legal-size hanging file folders (see FIG. 11). Similarly, in the inverted position, the distance of separation between side rail 25 and side rail 26 is approximately 12 inches and generally corresponds with the distance between opposite side support hooks of a regular-size hanging file folder. This then provides a unique versatility to the illustrated and disclosed device in that a single device serves both sizes of file folders and this versatility is achieved in part by the offset X-shaped arrangement. Alternatively, a similar concept could be employed with two single-piece end frame members of a trapezoidal shape as is illustrated in FIG. 10. FIG. 10 is a representation similar to FIG. 1 wherein a first end frame member 41 is arranged in alignment with, yet separated from, a second end frame member 42 and further includes four side rails which may be the same as side rails 23, 24, 25 and 26. Although this alternative arrangement is not pivotable to a collapsed position, as is illustrated in FIG. 4, which is preferred for packaging and storage convenience, the FIG. 10 alternative nevertheless provides the offset dimensional characterstics such that when edge 43 supports the rack, the distance of separation between the two top side rails is suitable for supporting legal-size file folders yet when inverted and edge 44 supports the rack, the opposite pair of side rails are suitably spaced for supporting regular-size file folders. It is further envisioned that yet other geometric shapes may be employed in which one orientation provides support for legal-size file folders and the inverted or opposite orientation provides support for regular-size file folders.

Referring to FIG. 4, the FIG. 1 file folder support rack 20 is illustrated in a collapsed position wherein first arm portion 29 of end frame member 21 is oriented in close proximity to second arm portion 30, both at the top half as well as at the bottom half, although the left-to-right orientations between top half and bottom half are reversed. This collapsed or folded position reduces the two aforementioned distances of separation to near zero. A similar arrangement exists for first arm portion 32 and second arm portion 33 on the opposite end although not specifically able to be illustrated due to the front elevation view employed. First arm portion 29 includes a first abutting edge 47, a second abutting edge 48 and a reduced thickness panel 49 which is approximately one-half of the overall thickness of other parts of this first arm portion 29. Similarly, broken lines 50 and 51 represent abutting edges on the back facing side of second arm portion 30 and panel 52 represents a half-thickness panel similar to panel 49. As should be apparent from the description provided, as first arm portion 29 and second arm portion 30 are pivotally expanded, one with respect to the other, the two reduced-thickness panels 49 and 52 are oriented into overlapping yet aligned relationship to each other such that the top plan view of FIG. 2 results in first end frame member 21 and second end frame member 22 appearing as being of uniform thickness although the three lines in the general vicinity of pivot means 31 and 34 indicate that there is actually a double thickness at that point provided by reduced-thickness panels 49 and 52.

Figure 5:
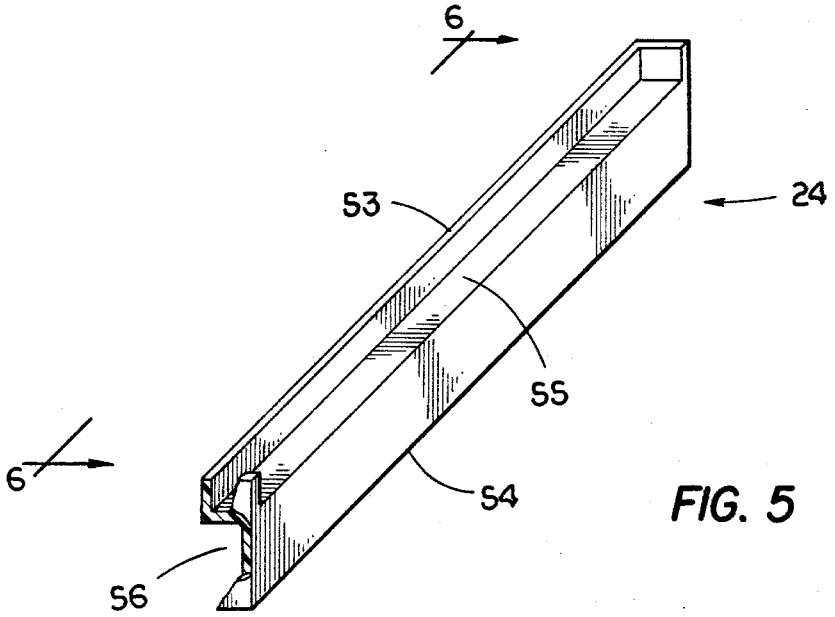
FIG. 5 is a fragmentary perspective view of one of the side rails comprising a portion of the FIG. 1 file folder support rack.
Figure 11:
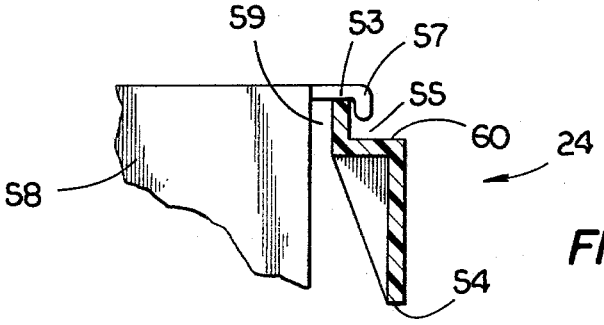
FIG. 11 is a diagrammatic partial front elevation view of a hanging file folder suspended by a side rail.
Figure 12:
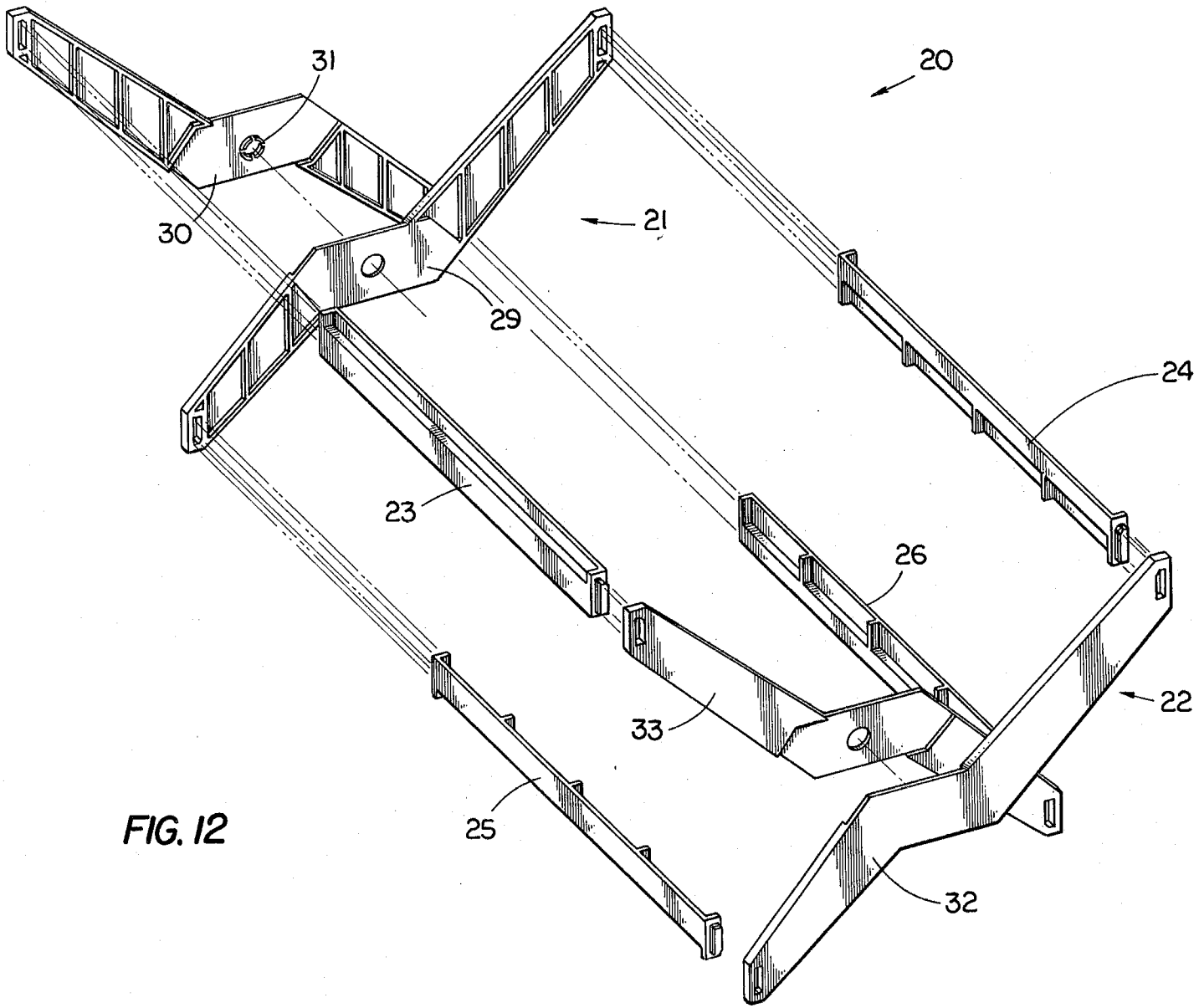
FIG. 12 is a perspective view in exploded form of the FIG. 1 file folder support rack.

Referring to FIG. 5, one of the four side rails is illustrated and for the benefit of reference clarity, this particular side rail will be referred to as side rail 24 due primarily to its particular orientation in FIG. 5. However, it is to be understood that side rails 23, 25 and 26 are virtually identical. Side rail 24 includes an upper edge portion 53, a lower edge portion 54 and two recessed areas 55 and 56. It is upper edge 53 which is oriented as part of support rack 20 to fit beneath the open region of support hooks 57 associated with hanging file folder 58 as is illustrated in FIG. 11. As is illustrated, it is important that the open region 59 beneath support hook 57 be wider than the thickness of upper edge 53 and that the height of upper edge 53 above surface 60 be greater than the downward protruding length of support hook 57.

Figure 7:
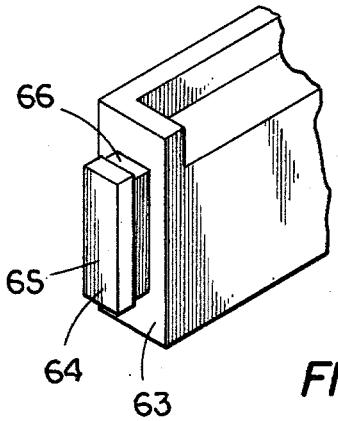
FIG. 7 is a partial perspective view of one end of the FIG. 5 side rail and detailing an outwardly protruding end portion.
Figure 8:
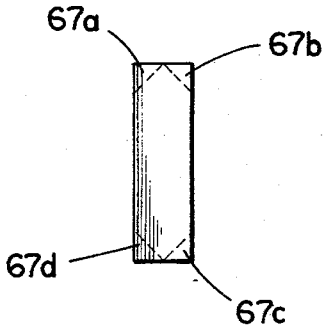
FIG. 8 is a diagrammatic front elevation view of the FIG. 7 outwardly protruding end portion showing corner modifications.
Figure 6:
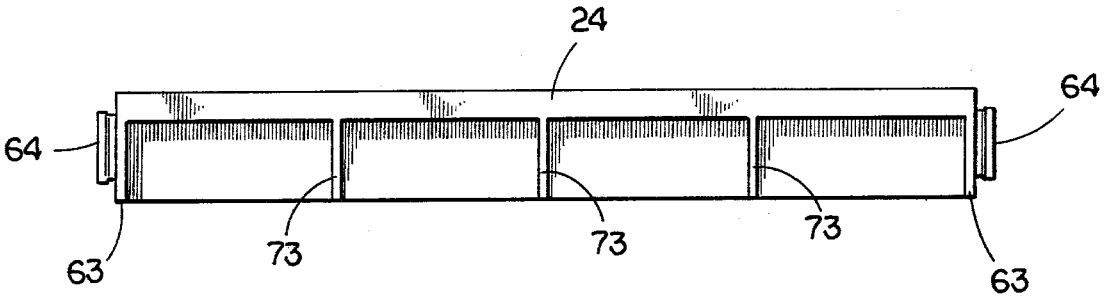
FIG. 6 is a front elevation view of the FIG. 5 side rail as taken along line 6—6 in FIG. 5.

Although each of the various side rails has this offset or stair-stepped design, it is to be understood that the outermost ends of each side rail are enclosed with a generally rectangular-shaped panel portion 63 which supports an outwardly protruding end portion 64 which is in the form of a snap-in boss (see FIGS. 6 and 7). Each of the four corners of each end frame member is provided with a clearance aperture of a general peripheral shape corresponding to the outer periphery shape of each outwardly protruding end portion 64 at the point at which the end portion is contiguous with the inside edge of the corresponding clearance aperture. In addition, each outwardly protruding end portion 64 has an outermost enlarged portion 65 and a smaller neck portion 66. It is this different size configuration between enlarged portion 65 and neck portion 66 which provides the snap-in feature and the permanent locking or retention feature of the various side rails to and between the two end frame members. While a variety of snap-in means or features may be employed in order to retain such side rails to their corresponding corner locations within the end frame members, it is desirable to have some type of snap-in feature which would enable easy assembly of the file folder support rack 20 from a kit of loose parts. Although the illustration of FIGS. 6 and 7 suggest that the two stages of outwardly protruding end portion are each rectangular, this is for general reference only and in fact, a further feature of the disclosed invention is that the enlarged portion 65 is further contoured as is diagrammatically represented in FIG. 8. A close review of FIGS. 1, 4 and 10 should reveal that one corner of portion 65 of each of the various side rails has been cut at an angle as is illustrated by FIG. 8. Although FIG. 8 illustrates that any one of the four corners 67*a*, 67*b*, 67*c* and 67*d* may be cut at such an angle, it is important that the cutting of the particular corners be such so as to assure fool-proof assembly of the various side rails into their corresponding corner apertures. The enlarged portion 65 of each outwardly protruding end portion 64 has a transverse cross-sectional shape which corresponds to the specific contour of the various clearance apertures at each corner of the end frame members. However, it is the smaller neck portion which actually fits into the aperture. While any of these four corners may be cut and any combination of corners may be cut on any one particular side rail, it should be apparent from the FIG. 1 illustration that so long as the corner is cut which is closest to the upper edge 53, which is to support the particular hanging file folder, that all of the side rails can be cut identically but that their subsequent installation into the various recesses will assure that the upper edge 53 of each side rail is properly oriented for support of the file folders.

A further feature of this invention is that the various structural members which have been previously discussed are molded from relatively thin plastic and this contributes to the lightweight as well as to the overall low cost associated with such a file folder support rack. Due to the use of thin plastic with the specific arrangement employed internal stiffening ribs are provided and these ribs are molded in as part of the various arm portions as well as the side rails and provides a support rack which is extremely strong and capable of supporting several pounds in weight of file folders and material.

Figure 2:
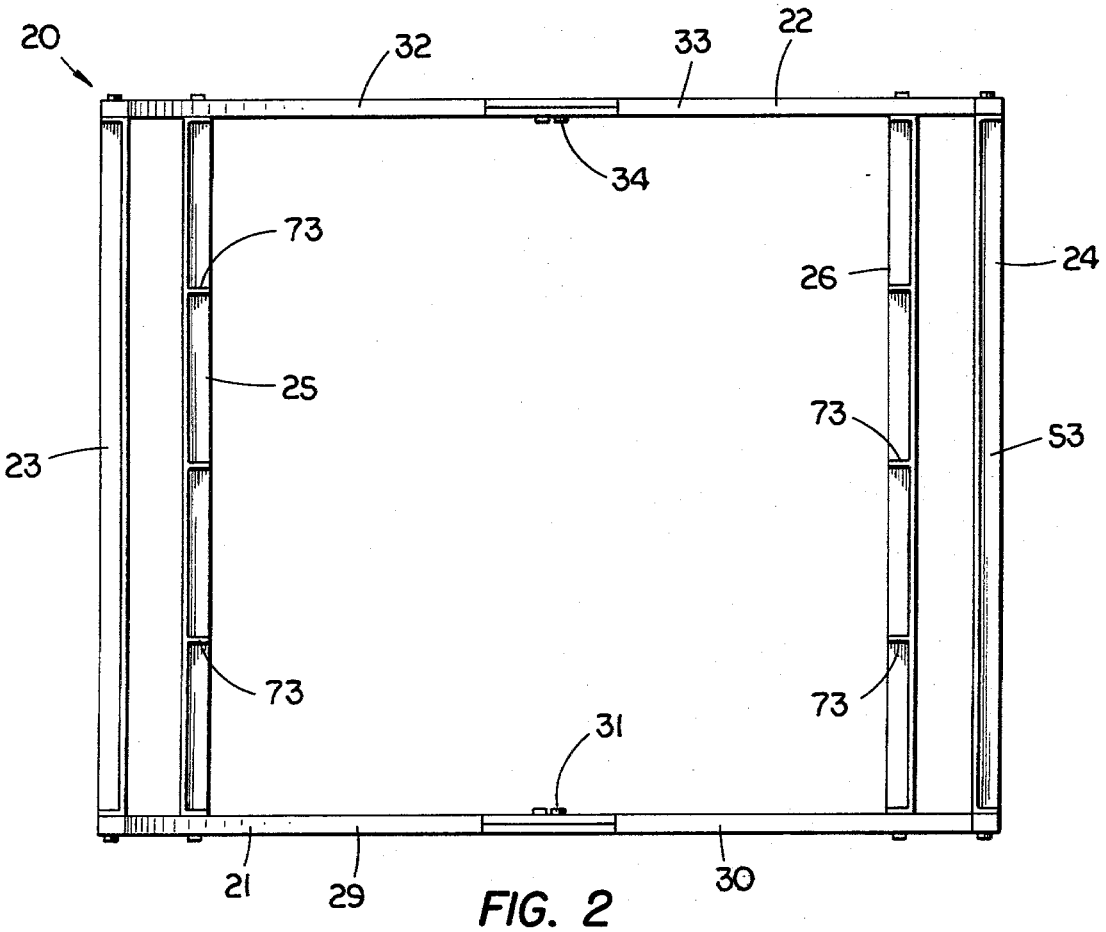
FIG. 2 is a plan view of the FIG. 1 file folder support rack.
Figure 3:
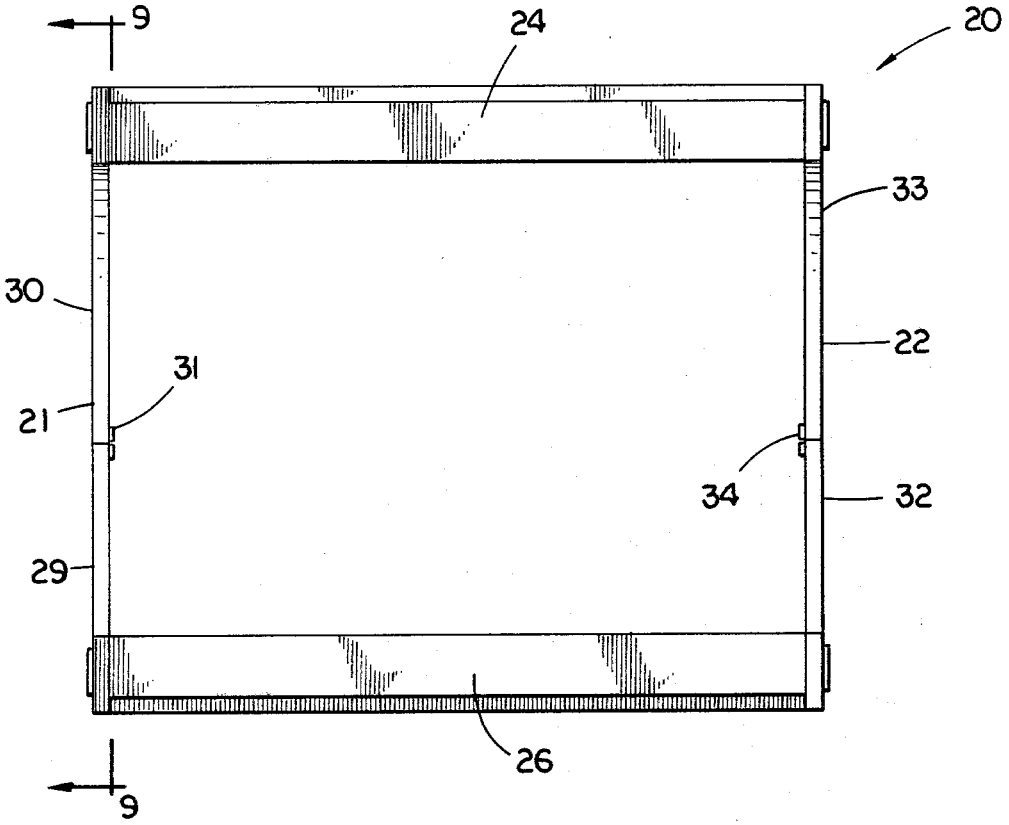
FIG. 3 is a side elevation view of the FIG. 1 file folder support rack.
Figure 9:
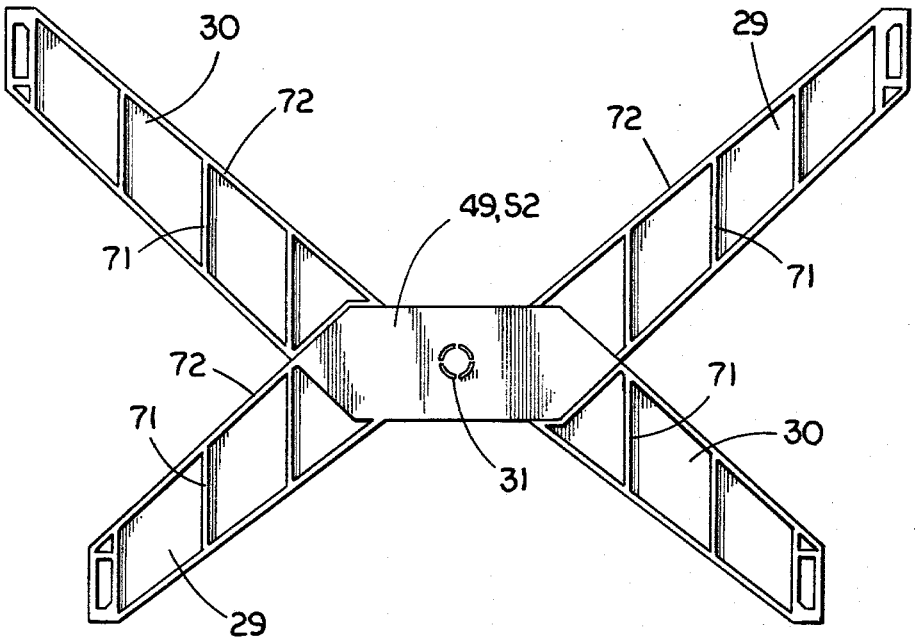
FIG. 9 is a front elevation view of one end frame member comprising a portion of the FIG. 1 file folder support rack as taken along line 9—9 in FIG. 3.

FIG. 9 is an internal end view of first end frame member 21 as viewed along line 9—9 in FIG. 3. First arm portion 29 and second arm portion 30 are illustrated as well as the pivot means 31 associated therewith. The elongated diamond-like shape in the middle corresponds to the area occupied by reduced thickness panels 49 and 52 and provides a better illustration of their overlapping and aligned shape. The various structural ribs 71 are illustrated as well as raised edges 72 which also provide structural support so as to enable the use of such thin molded plastic for these various members. Similar structural ribs 73 are illustrated in FIG. 2 and FIG. 6 and these correspond to the ribs of the various side rails.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A support device for retaining file folders of the type having a support hook on each corner in a suspended upright orientation, said support device comprising:

two aligned, oppositely disposed end frame members each having a configuration which provides a four-corners arrangement, the upper two corners of each end frame member having substantially the same first distance of separation and the lower two corners of each end frame member having substantially the same second distance of separation, said second distance of separation being different than said first distance of separation, each of said end frame members includes a first offset arm portion and a second offset arm portion pivotally connected to said first offset arm portion at a generally central location, said arm portions being movable with respect to each other between an unfolded offset X-shaped configuration and a folded closed configuration wherein said first distance of separation and said second distance of separation are substantially reduced to zero; and a plurality of side rails extending between corners of one end frame member and corresponding corners of the other end frame member, each of said side rails having an edge portion suitable to receive said support hooks.

2. The support device of claim 1 wherein each of said four corners of said end frame members is provided with a clearance aperture extending therethrough and each of said side rails has two outwardly protruding, oppositely disposed end portions arranged to snap into corresponding ones of said clearance apertures.

3. The support device of claim 1 wherein each of said arm portions are substantially flat and provided with surface contouring, said surface contouring providing an edge against which the other arm portion of the same end frame member abuts when in said unfolded offset X-shaped configuration.

4. The support device of claim 2 wherein the two outwardly protruding end portions of each of said side rails having a transverse cross-sectional shape which corresponds to the specific contour of said clearance apertures such that the edge portion of each side rail is forced to correspond to its proper orientation when said side rails are snapped into place into said end frame members.

5. A support device for retaining file folders of the type having a support hook on each corner in a suspended upright orientation, said support device comprising:

two aligned, oppositely disposed end frame members each having a configuration wich provides a four-corners arrangement, the upper two corners of each end frame member having substantially the same first distance of separation and the lower two corners of each end frame member having substantially the same second distance of separation, said second distance of separation being different than said first distance of separation; and four side rails each of which extends between a different one of the four corners of one end frame member and corresponding corners of the other end frame member, each of said side rails having an edge portion suitable to receive said support hooks, said side rails comprising the sole means of interconnection between said two end frame members, each of said four corners of each of said end frame members is provided with a clearance aperture extending therethrough, each of said clearance apertures being substantially identical as to their shape, yet each being differently oriented relative to their corresponding corner, and each of said side rails having two oppositely disposed outwardly protruding end portions arranged to snap into corresponding ones of said clearance apertures, each end portion having an enlarged head section and a reduced neck section, said enlarged head sections each being shaped to correspond to a different one of said clearance apertures, said enlarged head sections being of a slightly larger size than said clearance apertures and said reduced neck sections being arranged for enabling a snap fit of said side rails into said end frame members, such that with said rails and end frame members snapped together, said enlarged head sections prevent inadvertent separation of said end frame members.

6. A hanging file folder support frame for file folders of the type having support hooks on the various corners comprising:

a first collapsible offset X-shaped member having two arms pivotally pinned together and surface contouring arranged for abutting engagement of one arm to the other arm when said support frame is expanded into said offset "X" shape;

a second collapsible offset X-shaped member aligned with and spaced apart from said first collapsible offset X-shaped member and having two arms pivotally pinned together and surface contouring arranged for abutting engagement of one arm to the arm when said support frame is expanded to said offset "X" shape; and four side rails extending between the free ends of said first collapsible offset X-shaped member and corresponding free ends of said second collapsible offset X-shaped member, each side rail having an edge portion suitably sized to receive and support said support hooks, the upper two of said side rails being separated from each other, when said support frame is expanded to said offset "X" shape, at a distance sufficient for the support of legal-size file folders and the lower two side rails being separated at a distance sufficient for the support of regular-size file folders when said frame is inverted.

* * * * *